United States Patent [19]

Honma et al.

[11] Patent Number: 4,821,068

[45] Date of Patent: Apr. 11, 1989

[54] IMAGE FORMING APPARATUS

[75] Inventors: Toshio Honma, Tokyo; Hiroaki Takeda, Kawasaki; Tadashi Suzuki, Yokohama, all of Japan

[73] Assignee: Canon Kabushiki Kaisha, Tokyo, Japan

[21] Appl. No.: 213,514

[22] Filed: Jun. 28, 1988

Related U.S. Application Data

[63] Continuation of Ser. No. 045,527, May 4, 1987, which is a continuation of Ser. No. 607,753, May 7, 1984, abandoned.

[30] Foreign Application Priority Data

May 10, 1983 [JP] Japan ..... 58-81141
May 10, 1983 [JP] Japan ..... 58-81142
May 10, 1983 [JP] Japan ..... 58-81143

[51] Int. Cl.[4] ..... G03G 15/00

[52] U.S. Cl. ..... 355/14 E; 355/14 R; 355/14 C; 118/663

[58] Field of Search ..... 355/14 D, 14 E, 14 C, 355/14 R, 8, 3 DD, 3 R; 118/663, 665, 688, 691, 712

[56] References Cited

U.S. PATENT DOCUMENTS 4,239,374 12/1980 Tatsumi et al. ..... 355/14 E
4,285,593 8/1981 Vinatzer ..... 355/68
4,335,953 6/1982 Tsuchiya et al. ..... 355/14 CH
4,361,395 11/1982 Washio et al. ..... 355/14 R
4,640,603 2/1987 Honma ..... 355/3 R

*Primary Examiner*—A. C. Prescott
*Attorney, Agent, or Firm*—Fitzpatrick, Cella, Harper & Scinto

[57] ABSTRACT

An image formation apparatus has an image forming section including an optical system for forming an image corresponding to an image of an original, a potential sensor for measuring a surface potential of a photosensitive drum for forming a latent image thereon, a potential measurement circuit for calculating an average value of the surface potential, and a controller for controlling an exposure of a halogen lamp according to an output for the potential measurement circuit. The apparatus can reproduce optimal images of different types of originals including newspaper articles or the like which generally cause background fogging.

10 Claims, 12 Drawing Sheets

IMAGE FORMING APPARATUS

This application is a continuation of application Ser. No. 045,527, filed on May 4, 1987, which in turn is a continuation of Ser. No. 607,753, filed on May 7, 1984, now abandoned.

BACKGROUND OF THE INVENTION

1. Field of the Invention

The present invention relates to an image formation apparatus such as a copying machine and, more particularly, to an apparatus which has an image density control function for determining an optimal image formation condition for each image formation.

2. Description of the Prior Art

A conventional copying machine is known which has an automatic density control function (to be referred to as AE hereinafter) for measuring the original density and for controlling image formation conditions such as the charge amount, the light exposure amount or quantity, or the developing bias voltage in accordance with the detection result of the original density.

In a copying machine of this type, AE measurement is performed prior to or simultaneously as the copy sequence. Therefore, even if the AE measurement result does not indicate optimal image formation conditions, the copy may be produced, resulting in a miscopy.

Furthermore, AE measurement does not provide satisfactory results for all types of originals. In other words, satisfactory AE measurements cannot be performed for some type of original (e.g., an original having an area to be subjected to AE measurement, which has a density extremely different from the rest of the original).

Another copying machine is known wherein the surface potential of a photosensitive drum is measured and the potential control light quantity control is performed on the basis of the measured surface potential. A copying machine of this type frequency uses a microcomputer for performing control of the overall sequence. Special display units or indicators are required to display the control contents.

With recent development in LSI techniques, a multifunctional and high-precision microcomputer has been realized. An A/D converter which has conventionally required a special separate IC can now be integrated into a 1-chip microcomputer. With this technique, analog data (information) is frequently supplied directly to a microcomputer and is processed in a software manner.

For this reason, data processing is a "black box" and cannot be monitored externally.

Meanwhile, a microcomputer incorporated into a copying machine controls displays and indicators at the control section of the machine, and the copying density control which has been conventionally performed by lever operation is now processed digitally.

SUMMARY OF THE INVENTION

The present invention has been made in view of the foregoings and the object is to provide an image formation apparatus which has an improved operability.

It is another object of the present invention to provide an image formation apparatus which can produce an optimal reproduced image.

It is still another object of the present invention to provide an image formation apparatus which has a simple construction.

It is still another object of the present invention to provide an image formation apparatus which allows effective utilization of the automatic density control function.

It is still another object of the present invention to provide an image formation apparatus which does not require a special display since a display for a different purpose also serves as a density display.

It is still another object of the present invention to provide an image formation apparatus which allows easy and low-cost maintenance.

The above and other objects and features of the present invention will become apparent from the following description taken in conjunction with the accompanying drawings.

BRIEF DESCRIPTION OF THE DRAWINGS

FIG. 10 is a timing chart showing operations of the respective circuit components during control rotation after the main switch is turned on;

DETAILED DESCRIPTION OF THE PREFERRED EMBODIMENTS

The preferred embodiment of the present invention will now be described in detail with reference to the accompanying drawings.

Figure 1:
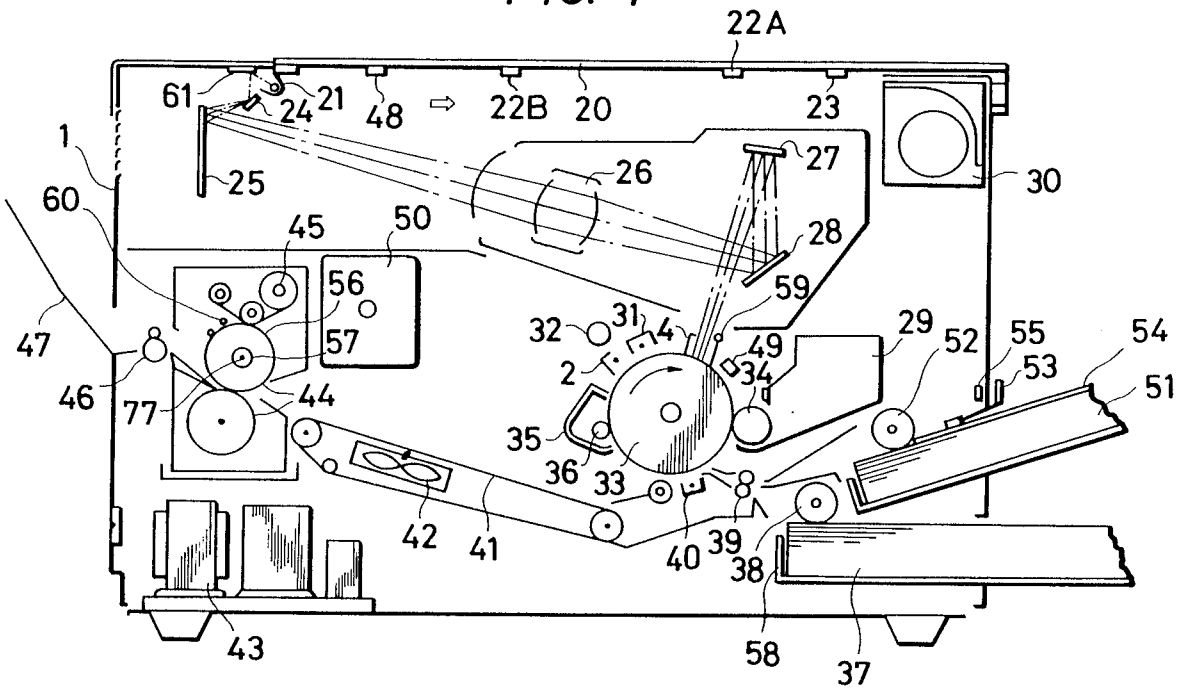
FIG. 1 is a sectional view of a copying machine to which the present invention can be applied.

FIG. 1 is a sectional view of a copying machine to which the present invention may be applied.

A photosensitive drum 33 rotates clockwise (indicated by the arrow) within a copying machine main body 1. A main motor 50 drives the photosensitive drum 33, a fixing unit having fixing rollers 44, a belt conveyor 41, a pickup roller 38, and an optical system including an original illumination lamp 21 through chains (not shown). The drum 33 is simultaneously discharged by a pre-exposure lamp 32 and a pre-discharge charger 2 and is thereafter corona-charged (e.g., positively) by a primary charger 31. Thereafter, the drum is slit-exposed at exposure point A to the image light irradiated from the illumination lamp 21.

The drum 33 is then charged by AC corona discharge or corona discharge to the polarity opposite to the primary charge (e.g., negatively) so as to form an electrostatic latent image of high contrast on the drum 33. The latent image on the drum 33 is developed by a developing roller 34 of a developing unit 29 and is visualized as a toner image.

Blank exposure lamps 59 are turned on during the drum rotation except for the exposure time of the original so as to erase the drum surface charge at the non-image portion and to prevent the toner from attaching to the non-image portion. For the same purpose, the blank exposure lamps 59 are turned on when a small size cassette is loaded or the reduced size copying is performed. Note that a plurality of blank exposure lamps 59 are arranged along the axial direction of the photosensitive drum 33. The toner image is transferred onto a transfer sheet at a transfer charger 40. Prior to this transfer operation, the transfer sheet is picked up from a cassette 37 by the pickup roller 38 at a timing at which the leading edges of the toner image and the transfer sheet coincide with each other. The sheet is then fed out by a register roller 39. At this time, the original is illuminated by the original illumination lamp 21. The optical system including the original illumination lamp 21 scans the original in the direction indicated by the arrow. The image is formed at the point A on the photosensitive drum 33 through reflecting mirrors 24, 25, 27 and 28 and a lens 26. Thus, the entire original is exposed. The lens 26 is a zooming lens which is moved for copy production in a different size by rotating the zoom ring to change the focal legnth. The zooming lens 26 is moved by a stepping motor (not shown) to a predetermined position corresponding to the preset size magnification. When a registration sensor 48 is operated, the register roller 39 is rotated so as to align the leading edges of the image and the transfer sheet. This sensor 48 also generates a reference signal during AE measurement or control. Inversion sensors 22A and 22B and 23 define the inversion positions of the optical system. More specifically, the inversion sensor 22B defines an inversion position when the cassette 37 is of small size (e.g., B5, A4 or the like). The inversion sensor 23 defines an inversion position when the cassette 37 is of large size (e.g., A3 size or the like).

Figure 2:
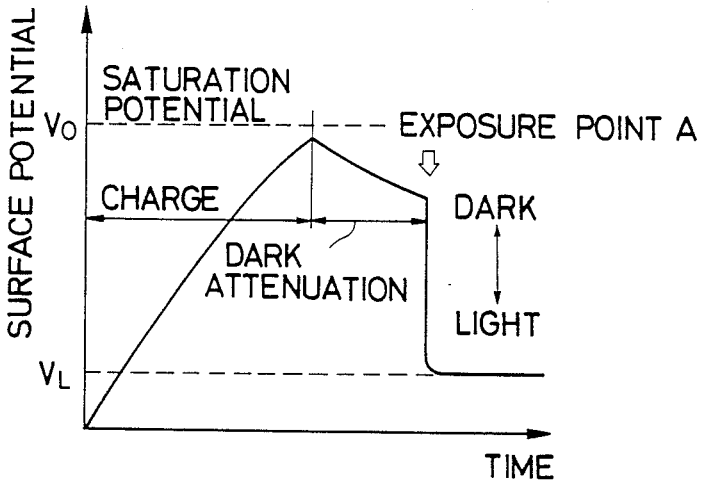
FIG. 2 is a graph showing the characteristics of the surface potential of a photosensitive drum.

The photosensitive drum 33 form which the image has been transferred is cleaned by a cleaner brush 36 at a cleaner unit 35 and is then electrostatically cleaned by an eraser 32 for the next charging operation. Meanwhile, the transfer sheet to which the toner image is transferred is separated from the photosensitive drum 33, conveyed by the belt conveyor 41, and directed toward the fixing rollers 44. During the convey operation, the transfer sheet is conveyed as drawn by suction downward by a suction fan 42. The image on the transfer sheet is fixed by the fixing rollers 44 incorporating a fixing heater 77 therein and the produced copy is exhausted onto an exhaust tray 47 by means of exhaust rollers 46. A web motor 45 winds up a web for cleaning the fixing rollers 44. A power source transformer 43 is arranged below the fixing rollers 44. A cooling fan 30 is at the upper right corner of the copying machine main body 1. A potential sensor 49 measures the surface potential of the photosensitive drum 33. In general, the photosensitive drum 33 has the surface potential as shown in FIG. 2. First, the drum surface potential is charged to VO by the corona discharge. Dark attenuation occurs before the exposure point A. At the exposure point A, the original is illuminated by the original illumination lamp 21, and reflected light having a level corresponding to the original density is irradiated onto the drum 33. If the original density is light, the quantity of reflected light is large and the surface potential is decreased to a level near VL, as shown in FIG. 2. Howver, if the original density is dark, the quantity of reflected light becomes small. Therefore, the dark or light density of the original can be determined by reading the surface potential.

Discrimination of the original density and control of the light illumination quantity or developing bias for the purpose of obtaining an optimum image will be referred to as AE control. AE control can also refer to measurement of the quantity of reflected light from the original by a photosensor for density discrimination for the same purpose as that described above.

Figure 3:
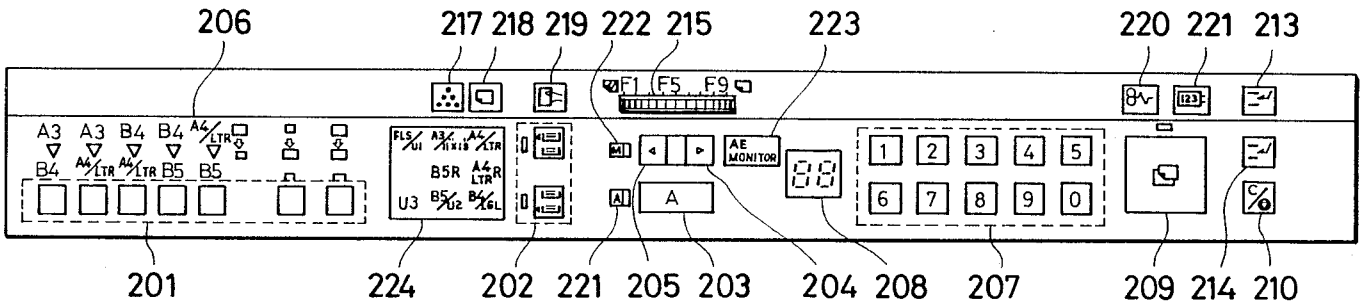
FIG. 3 is a plan view showing the control section of the copying machine.

FIG. 3 is a plan view showing the control panel of the copying machine main body 1. A magnification selection key 201 is used to set a desired magnification factor. The selected magnification is displayed by magnification display LEDs 206. When the magnification is changed by the operation of the key 201 by the operator, the lens 26 is moved to a corresponding predetermined position by the stepping motor so as to change its focal length. When the magnification is changed further during movement of the lens by the stepping motor, the movement of the lens is immediately stopped. Thereafter, the lens is moved again to a predetermined position with respect to a standard point. A cassette selection key 202 allows selection between two types of cassettes. Cassette size display LEDs 224 display the size of the selected cassette. When an AE selection key 203 is depressed, the AE mode is set and an AE mode display LED 221 is lit. A down key 205 and an up key 204 can be used to change the copy density stepwise. When the key 204 or 205 is depressed, the manual mode is selected, and a manual mode display LED 222 is lit. A density display 215 consists of 17 LEDs corresponding to light quantity intervals of 0.5 stop values from F1 to F9. When the down key 205 is depressed, the display of the display 215 is shifted by 0.5 stop value to the left. When the up key 204 is depressed, the display of the display 215 is shifted by 0.5 stop value to the right. When power is turned on or after copying operation or when the AE selection key 203 is depressed, the display value of the display 215 is F5.

A copy number set by a copy number preset key 207 is displayed by a copy number display 208. When a copy start key 209 is depressed, the copying operation is started. A clear/stop key 210 is for clearing the input data or for stopping the copying operation. When an interruption key 214 is depressed, the interruption mode is selected, and an interruption display lamp 213 is lit. When the interruption key is depressed again, the interruption mode is released.

A toner lamp 217 indicates whether or not there is sufficient toner left. A paper lamp 218 indicates whether or not there is a sufficient number of paper sheets left. A manual feed lamp 219 indicates whether or not the manual feed mode is selected. A jam display lamp 220 indicates occurrence of jamming, and a counter warning lamp 221 indicates there is no counter available. When an AE monitor key 223 is depressed in the standby mode, AE prescanning alone is performed for measurement of the original density. This key does not allow copying operation.

Figure 4:
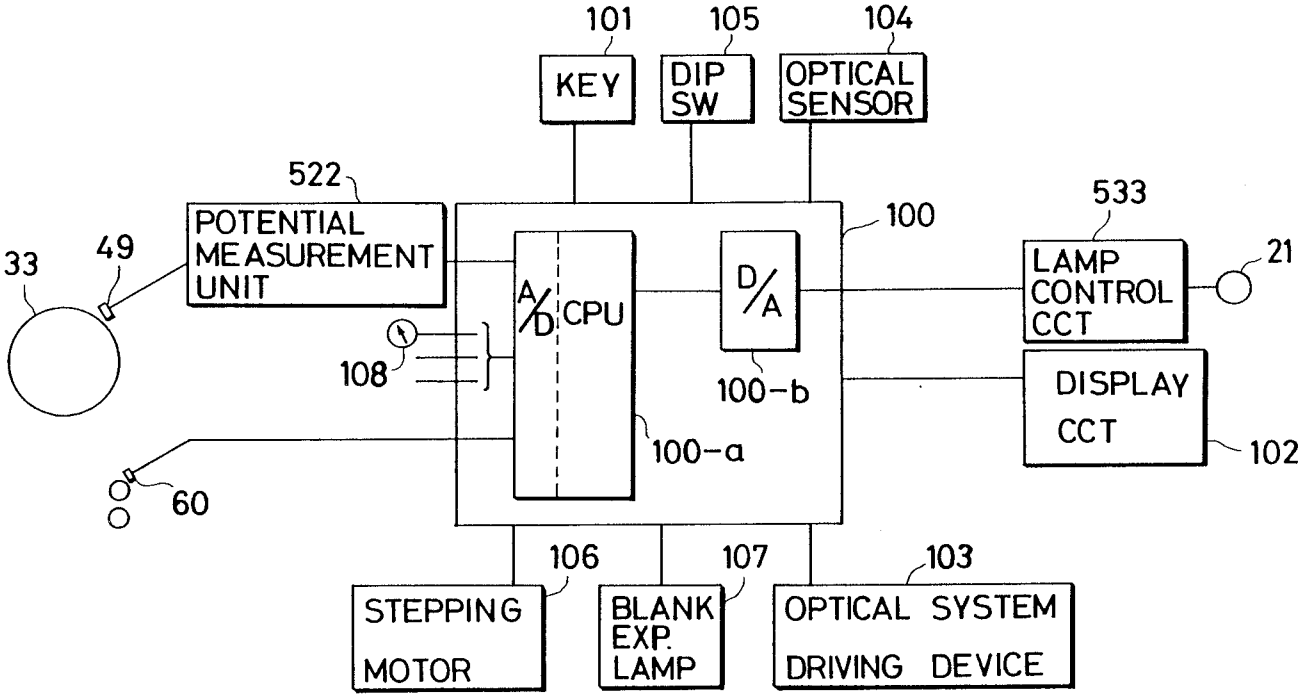
FIG. 4 is a block diagram of the control section of the copying machine.

FIG. 4 shows the hardware configuration for performing AE control according to the present invention.

Referring to FIG. 4, an output from the potential sensor 49 arranged near the drum 33 is supplied to a potential measurement unit 522. A controller 100 includes a 1-chip microcomputer 100-*a* having a ROM, a RAM, and an A/D converter; and a D/A converter 100-*b*.

A key group 101 and a display circuit 102 are included in the control panel shown in FIG. 3. An input through the key group 101 is supplied to the controller 100 by a known matrix system. The display circuit 102 can turn on the LEDs by dynamic firing circuits and the lamps by lamp firing circuits. An optical system position sensor 104 consists of the inversion sensors 22A, 22B and 23, the registration sensor 48, and the like shown in FIG. 1.

A DIP switch 105 is for use by a service personnel and is used to display the check data excluding the stop value utilizing 17 LEDs (215 in FIG. 3) at the control panel.

A temperature sensor 60 is at the fixing unit having the fixing rollers 44. A volume group 108 has volumes for AE and potential control. A lamp control circuit 533 controls firing of the illumination lamp 21. An optical system driving device 103, a stepping motor 106 for moving the lens, and a blank exposure lamp group (corresponding to 59 in FIG. 1) 107 are connected to the controller 100.

An 8-bit A/D converter is incorporated in the microcomputer 100-*a* of this embodiment. The A/D converter directly receives an analog potential and converts a potential across the analog GND terminal and the power supply terminal into a digital potential at a resolution of 256 steps (8 bits). The A/D converter has 8 analog input terminals and performs sequential A/D conversion by time division.

According to the present invention, the surface potential of the drum, the AE and potential control volume values, the temperature sensor output of the fixing unit, and the like are directly supplied in the form of analog values to the microcomputer 100-*a*.

The surface potential of the drum 33 is detected by the potential sensor 49 and the detected surface potential is attenuated or level shifted to a suitable analog value by the potential measurement unit 522.

The temperature of the fixing rollers 44 is directly supplied to the controller 100 as an analog value representing a change in resistance of the temperature sensor 60 near the rollers 44.

An output from the microcomputer 100-*a* is supplied to the D/A converter 100-*b*, an analog output from which is supplied to the lamp control circuit 533. The lamp control circuit 533 supplies to the illumination lamp 21 power corresponding to the analog voltage from the A/D converter 100-*b*.

In this manner, the microcomputer 100-*a* can freely set power to be supplied to the illumination lamp 21 so as to present the light exposure quantity.

Figure 5:
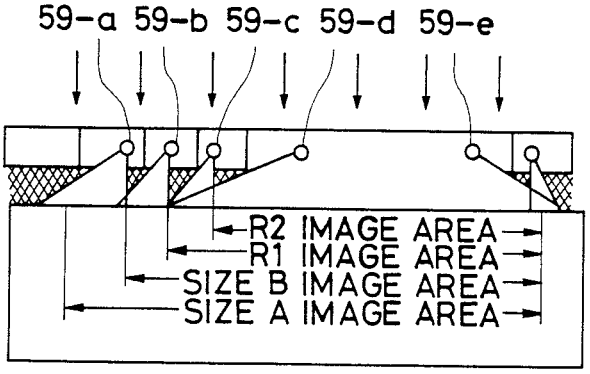
FIG. 5 is a representation showing the arrangement of five blank exposure lamps.

A blank exposure lamp group 107 consists of five lamps and has a section as shown in FIG. 5. A B size blank 590*a* is for size B paper sheets smaller than size A paper sheets. An R1 blank 59-*b* is turned on for R1 reduction copying. An R2 blank 59-*c* is turned on for R2 reduction copying. Standard blanks 59-*d* and 59-*e* are turned on during non-copying operation so as to prevent wasteful consumption of toner. In any case, the lamps are used in combinations.

An optical system driving circuit 103 can drive the optical system back and forth. The position sensor 104 of the optical system connected to the controller 100 produces an output corresponding to the position and movement of the optical system. Based on data from a plurality of position sensors, the controller 100 can drive the optical system driving circuit 103 or the register roller 39.

After the change in the magnification is instructed through the key 101, the stepping motor 106 moves the lens to the predetermined position by the 2-phase excitation system under the instruction of the controller 100. In order to improve the stop position precision by the stepping motor, the lens is always stopped in the same direction toward the predetermined position. When power is turned on for copying on a sheet of an enlarged size, the lens is moved beyond the standard position. When a change in the magnification is instructed during movement of the lens, the lens movement is immediately stopped and lens positioning is resumed with reference to the standard position.

The microcomputer capable of AE control according to the present invention processes within 1 chip for not only AE control but also for the copying operation and the potential control function. The copying sequence will now be described below with reference to the flow charts shown in FIGS. 13 to 16.

Figure 10:
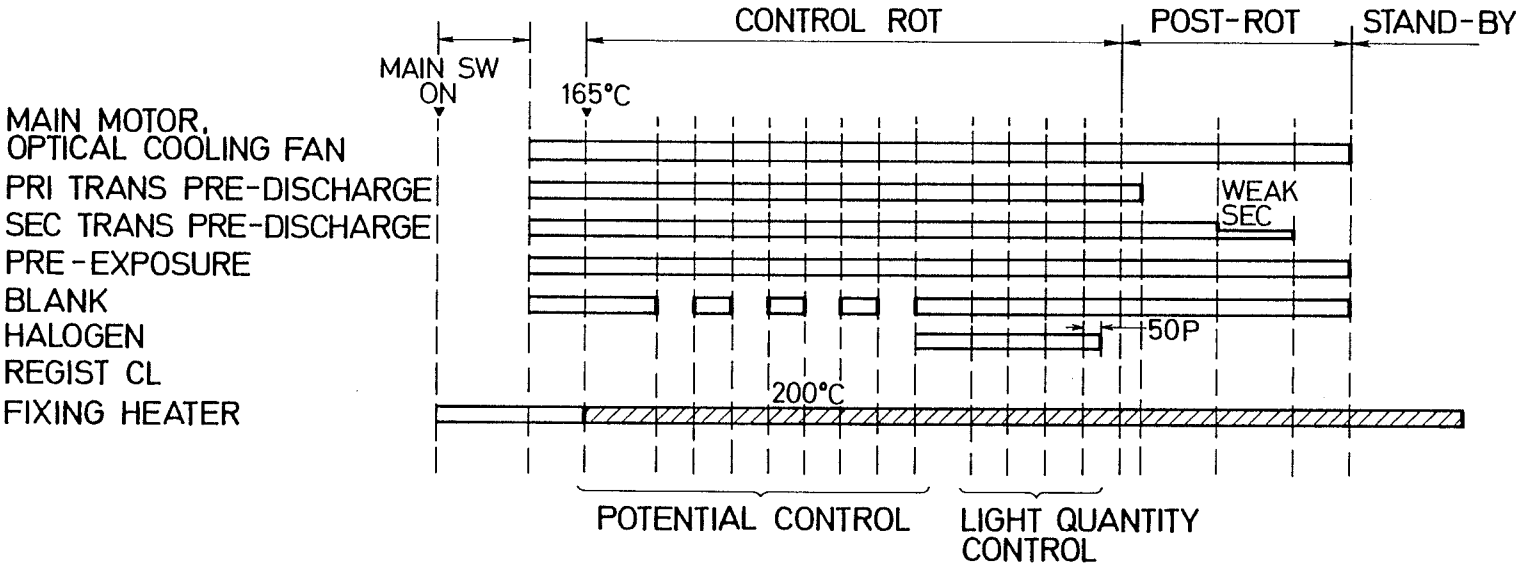

FIG. 10 is a timing chart showing the operation when the main switch is turned on. The control sequence will now be described with reference to FIG. 10.

When the main switch is turned on, the fixing heater 77 is turned on. After a predetermined time period (50 seconds), the main motor 50 is energized to rotate the drum 33 and the fixing rollers 44. At the same time, a high voltage is applied to the primary charger 21 and a secondary charger 4 so as to turn on the pre-exposure lamp 32 and the blank exposure lamps 59. Thus, any residual charge on the drum 33 is discharged or the drum 33 is charge removed. When the fixing rollers 44 reach a first preset temperature (165° C.), control rotation is started. Thereafter, the fixing rollers 44 are controlled to be normally kept at a second preset temperature (200° C.).

Control rotation consists of potential control and light quantity control. During the potential control, while the blank exposure lamps 59 are turned on, a drum surface potential (to be referred to as VSL hereinafter) is measured by the potential sensor 49. Then, while the blank exposure sensors 59 are off, the drum surface potential (to be referred to as VD hereinafter) is measured. In accordance with the measured VSL and VD values, a high voltage current to flow into the primary and secondary chargers 31 and 4 is controlled, so as to obtain optimal VSL and VD values. This control sequence is repeated four times so as to obtain stable contrast.

The light quantity control is then commenced. The original illumination lamp 21 is turned on to irradiate with light a standard white plate 61 corresponding to the reflectance of the white portion of the original. The potential (to be referred to as VL1 hereinafter) of the drum 33 is measured by the potential sensor 49. The light quantity of the original illumination lamp 21 is shifted to the lamp control circuit 533 such that the potential VL1 becomes 0 V. This VL measurement is performed three times to optimally control the original illumination lamp 21.

The halogen lamp light quantity which provides 0 V surface potential obtained by such light quantity control will be referred to as standard light quantity. Thus, the light quantity generally corresponding to F5 can be variable at times according to light quantity control in this copying machine.

The standard light quantity may be considered as the sum of the specific standard value and the light quantity control correction voltage.

Finally, the VL is measured, and the measured value is defined as VL2. The control rotation is then terminated. The value of VL2 is used for AE control to be described later.

Post-rotation is then performed. The primary charger 31 is turned off, and thereafter the high voltage output to the second charger 4 is reduced. After the drum rotates for a predetermined angle, the second charger 4 is turned off. This operation is performed to eliminate the irregularity of the surface potential and then to stop the drum. Thereafter, all the machine components except for the fixing heater 77 are stopped, and the machine is set in the standby mode awaiting for a next key input.

When the fixing rollers 44 reach the first preset temperature (165° C.) within a predetermined time period (50 seconds) after the main switch ON timing, the control rotation is immediately started. The fixing temperature of the toner is about 180° C. If the control rotation is started at a temperature of 165° C. in this manner, the fixing rollers 44 will have reached the temperature of 180° C. after completion of the control rotation. Thus, the waiting time can be shortened.

During the light quantity control, the lens position is not limited to that for equal size copying. The lens is fixed at the position during the light quantity control, which was selected before this control. Although a change in the magnification is accepted during the control rotation, the actual lens movement is performed after the light quantity control.

Figure 11:
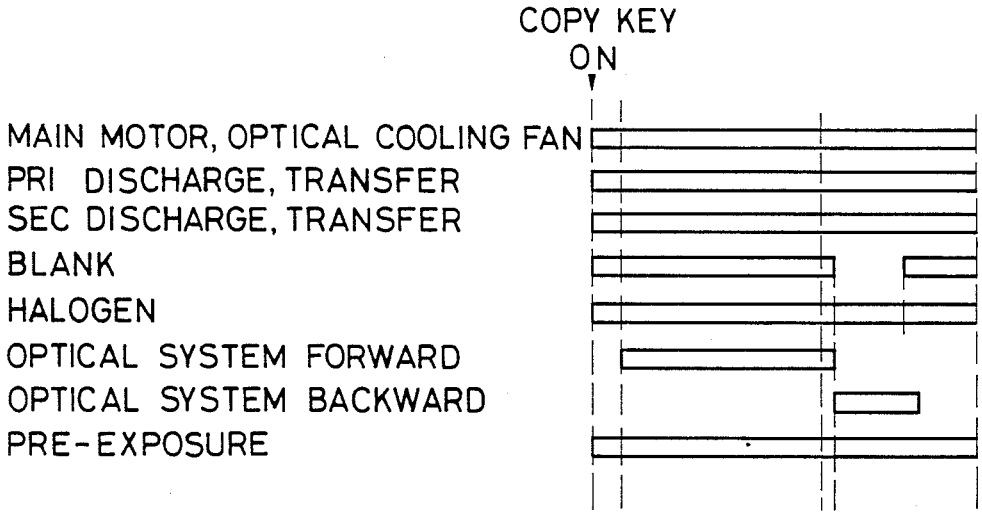
FIG. 11 is a timing chart showing the operations of the respective circuit components during AE measurement.

The series of operation from the AE measurement upon input through the copy start key 209 to the AE copy when the AE mode is selected by the AE selection key 203 will now be described with reference to the timing chart shown in FIG. 11.

When the AE copy is started by the copy start key 209, the lens is set at the position corresponding to the preset magnification. Thereafter, the drum 33 is rotated, and the optical system is moved to a predetermined position.

At this time, the illumination lamp 21 illuminates at the standard light quantity, and is turned on by a standard voltage.

Then, the optical system is moved back to the home position (pre-scanned). In accordance with an output signal from the optical system position sensor 104, the microcomputer **100-*a* samples the surface potential VDR of the drum 33**.

In accordance with the signals from the optical system position sensor 104, the VDR is sampled a plurality of times, and the average VDM is calculated. This sampling is performed when the image on the drum corresponding to the predetermined position on the original reaches the surface potential sensor. Therefore, the average VDM corresponding to the density at the predetermined position of the original can be obtained.

After the optical system is returned to the home position, the illumination lamp 21 is turned on by the firing voltage which is obtained by correcting the standard value in accordance with the value of the VDM. The optical system is moved in the forward direction again to perform image exposure. Density display corresponding to the firing voltage can also be performed.

Figure 6:
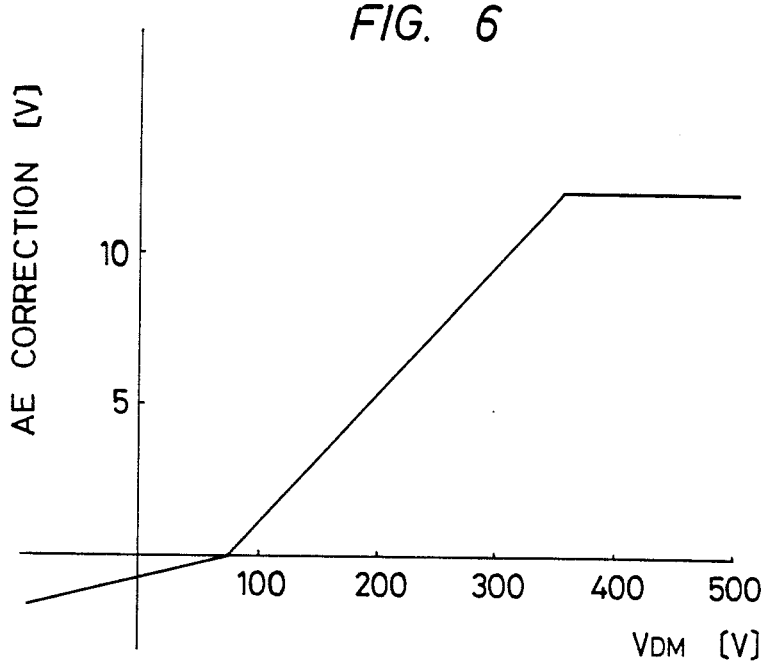
FIG. 6 is a graph showing the halogen lamp ON voltage correction value as a function of the average surface potential of the drum during AE measurement.
Figure 7:
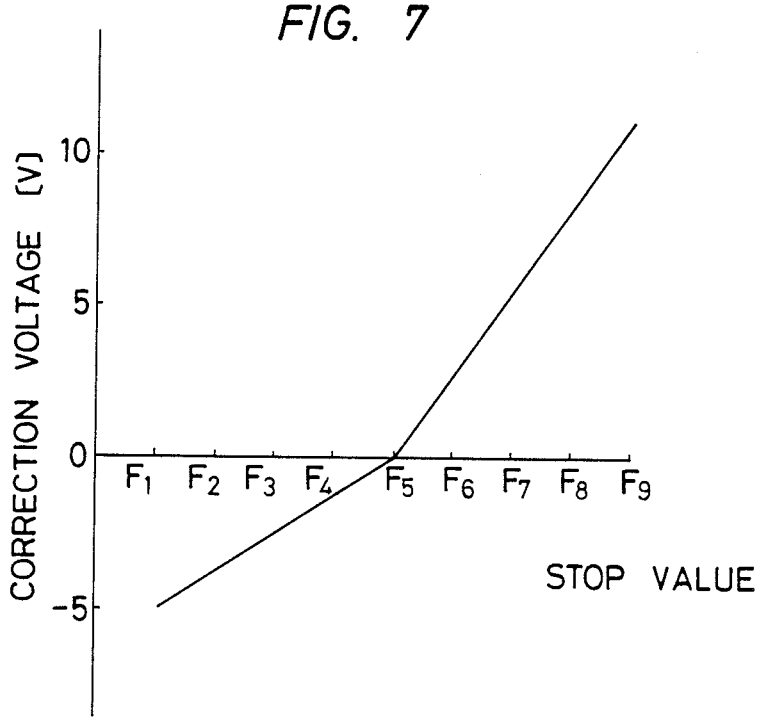
FIG. 7 is a graph showing the halogen lamp ON voltage correction value as a function of the stop value.

FIG. 6 shows the AE correction value as a function of the value of the VDM, and FIG. 7 shows the halogen correction value as a function of the density display value.

For example, when VDM =75 V, that is, for a standard original, the correction value is 0. In this case, during the original exposure, the illumination lamp is illuminated at the standard light quantity.

At this time, the stop display indicates F5.

In the case of an original such as a newspaper article which frequently causes background fogging, the VDM becomes about 300 V. In this case, as shown in FIG. 6, an AE correction value of about 9.6 V is required. During original exposure, the illumination lamp is turned on at the standard value of +9.6 V. Since the light quantity is increased, the background portion may not be erroneously reproduced in a dark color, thus producing an optimal image.

The stop value in this case is F8.5 as shown in FIG. 7.

Figure 14:
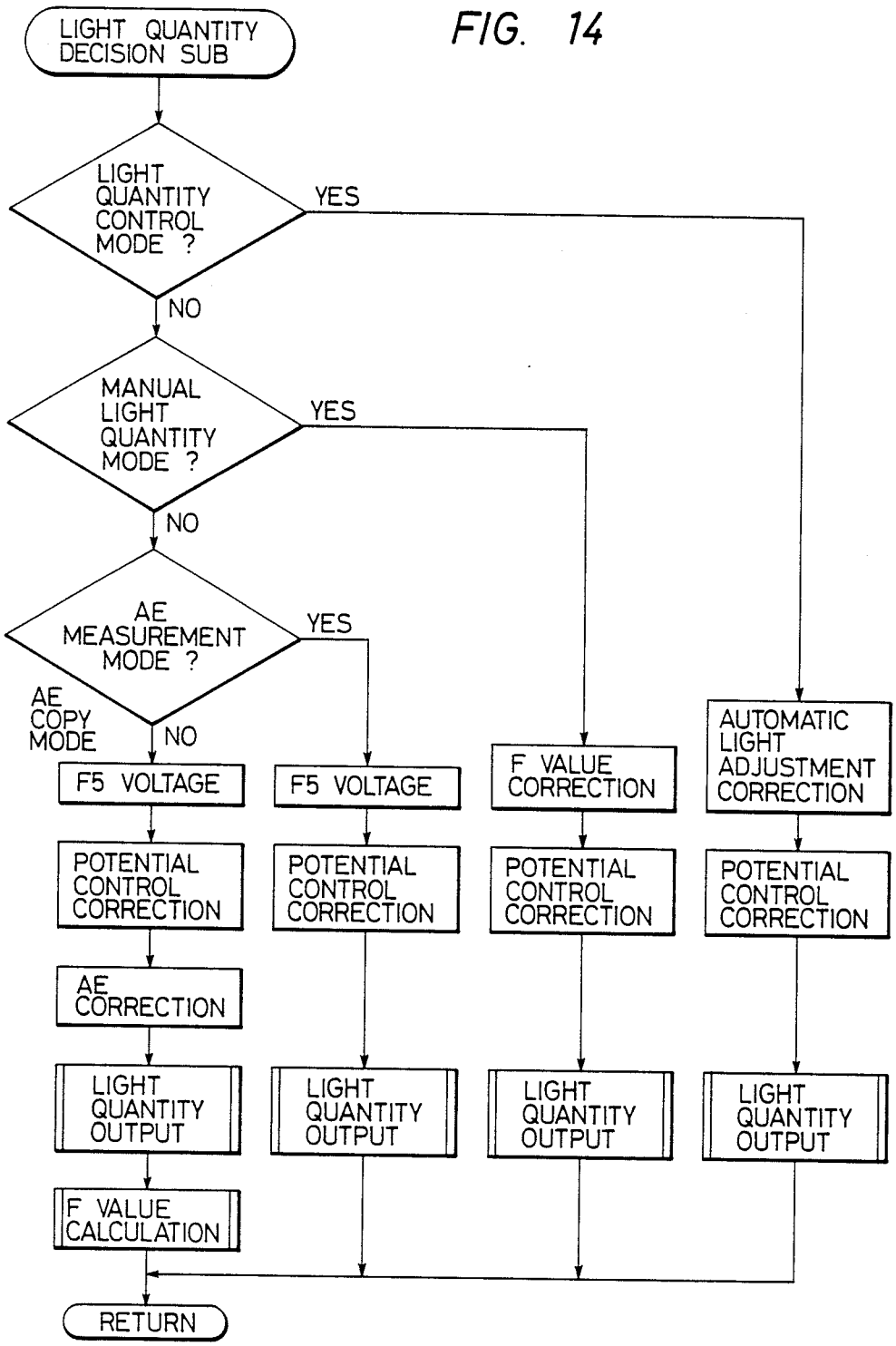
FIG. 14 is a flow chart showing the control flow for determining the halogen lamp light quantity.

The control flow for determining the light quantity is shown in FIG. 14.

As for the AE correction curve shown in FIG. 6, it must be frequently corrected in accordance with the machine conditions or by user's special demands.

In the embodiment of the present invention, the curve correction value can be directly supplied in the form of an analog value to the microcomputer **100-*a***.

More specifically, the AE curve can be shifted parallel to the original curve by a control volume (satisfactory for changing the standard value), or the slope of the AE curve can be changed.

Figure 8:
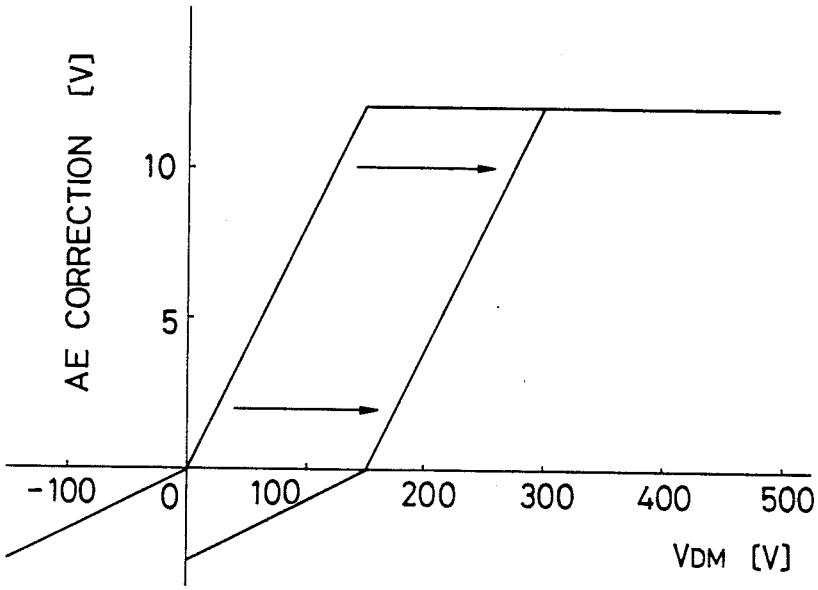
FIG. 8 is a graph showing the shift of the AE correction curve to the right by means of the AE control volume.
Figure 9:
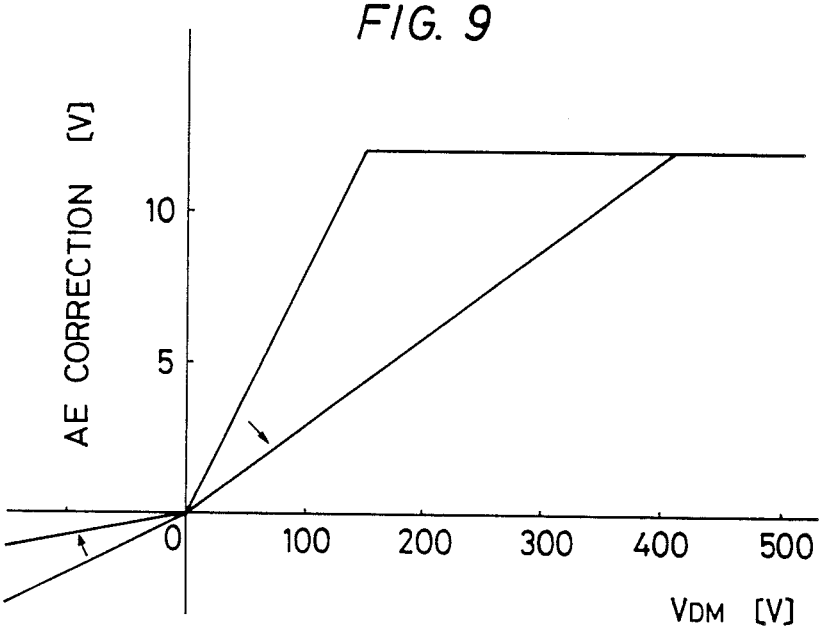
FIG. 9 is a graph showing the change in the slope of the AE correction curve by means of the AE control volume.
Figure 15:
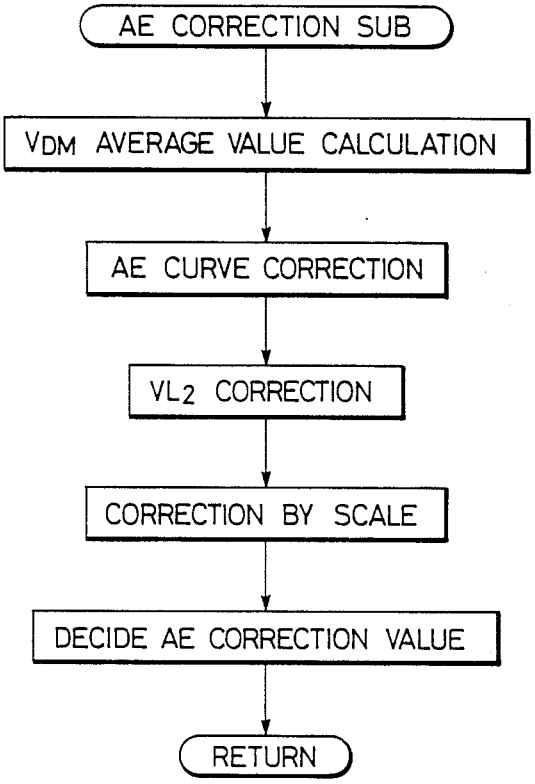
FIG. 15 is a flow chart showing the control flow for correcting the AE correction value.

These AE curve shifts are shown in FIGS. 8 and 9. FIG. 15 shows the control flow for AE correction.

The calculation of the halogen lamp light quantity according to these AE curves is performed by the microcomputer **100-*a* in accordance with external input data, and an analog output for controlling the halogen lamp light quantity is produced. In accordance with the halogen lamp light quantity value, the stop value is also calculated internally and is displayed at the stop display 215**.

If the standard light quantity is incorrect in the case of the AE correction (if VL2 is not 0 after a predetermined number of control procedures as described above), further correction in addition to the AE correction is performed. For example, if VL2=5 V, the AE correction value is determined in accordance with the VDM and an error of 5 V of the VL2.

The factors for determining the AE correction value are summarized as follows:

| | |
|---|---|
| Specific standard light quantity<br>Correction by light quantity control | Standard light control |
| Standard light quantity<br>Drum average potential by AE measurement<br>Slope of AE curve | AE exposure |

-continued

| |
|---|
| Shift amount of AE curve |
| Error in VL2 in light quantity control |

In the manner as described above, average value VDM of the surface potential corresponding to the density of the original is performed by prescanning. The firing voltage of the illumination lamp is controlled in accordance with the obtained value of the VDM. Thus, a suitable copy can be produced for any type of original. Density display corresponding to the original density is performed.

If the AE mode is not selected, when the copy start key 209 is depressed, the drum starts rotating. The illumination lamp 21 is turned on at the light quantity which is the sum of the standard light quantity and the manual correction value selected by the density control means. Thereafter, the optical system starts the forward movement and the image exposure scanning is performed.

When a copying operation in a different magnification is requested by a key operation, light quantity control is performed before the copy sequence. When the copy start key 209 is depressed and the magnification for this operation is different from that for the previous operation, the optical system is returned to the home position. Thereafter, the light quantity control as described above is performed, and the change in the standard light quantity for the different magnification is corrected.

If the AE mode is set, the slope of the AE curve is changed for controlling the AE correction value for each magnification. This change in the slope of the AE curve is performed by the volume for controlling the slope of the curve described above, and the slope of the AE curve is in practice a function of the control volume and the copy magnification.

According to the copying macihine of the present invention, the potential control and AE control are entirely performed by a single 1-chip microcomputer 100-*a*. Input data is supplied to the microcomputer 100-*a* through predetermined input ports at specific timings. The microcomputer then produces a halogen light quantity or the like. Means for indicating the data processing is thus required.

In the copying machine of the present invention, the input information data fetched in the microcomputer 100-*a* can be supplied to the density display LEDs by means of the display selecting means comprising a DIP switch an output from which is supplied to the microcomputer 100-*a*. Thus, the drum surface potential, the average value VDM of the drum surface potential in AE measurement, the bright portion potential VSL in potential measurement, the dark portion potential VD, the VL2 in light quantity control, and the like can be digitally displayed. This selecting means is not always necessary for general users and is not therefore arranged on the control panel.

Figure 12:
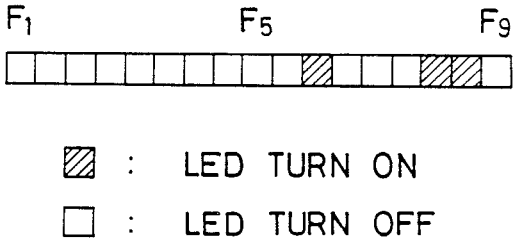
FIG. 12 is a plan view of a stop display which can display various internal data.
Figure 13:
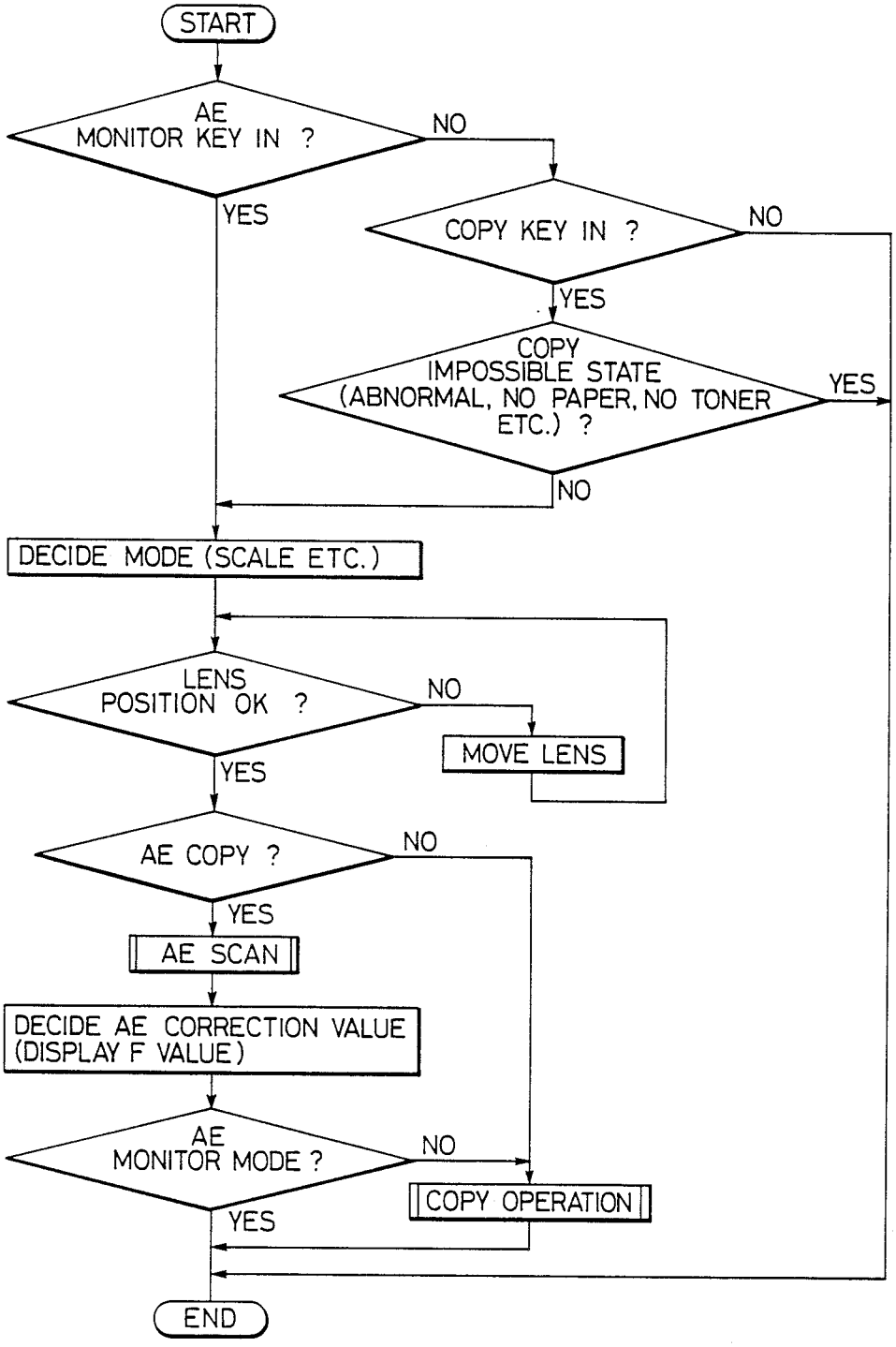
FIG. 13 is a general flow chart of the copying operation.
Figure 16:
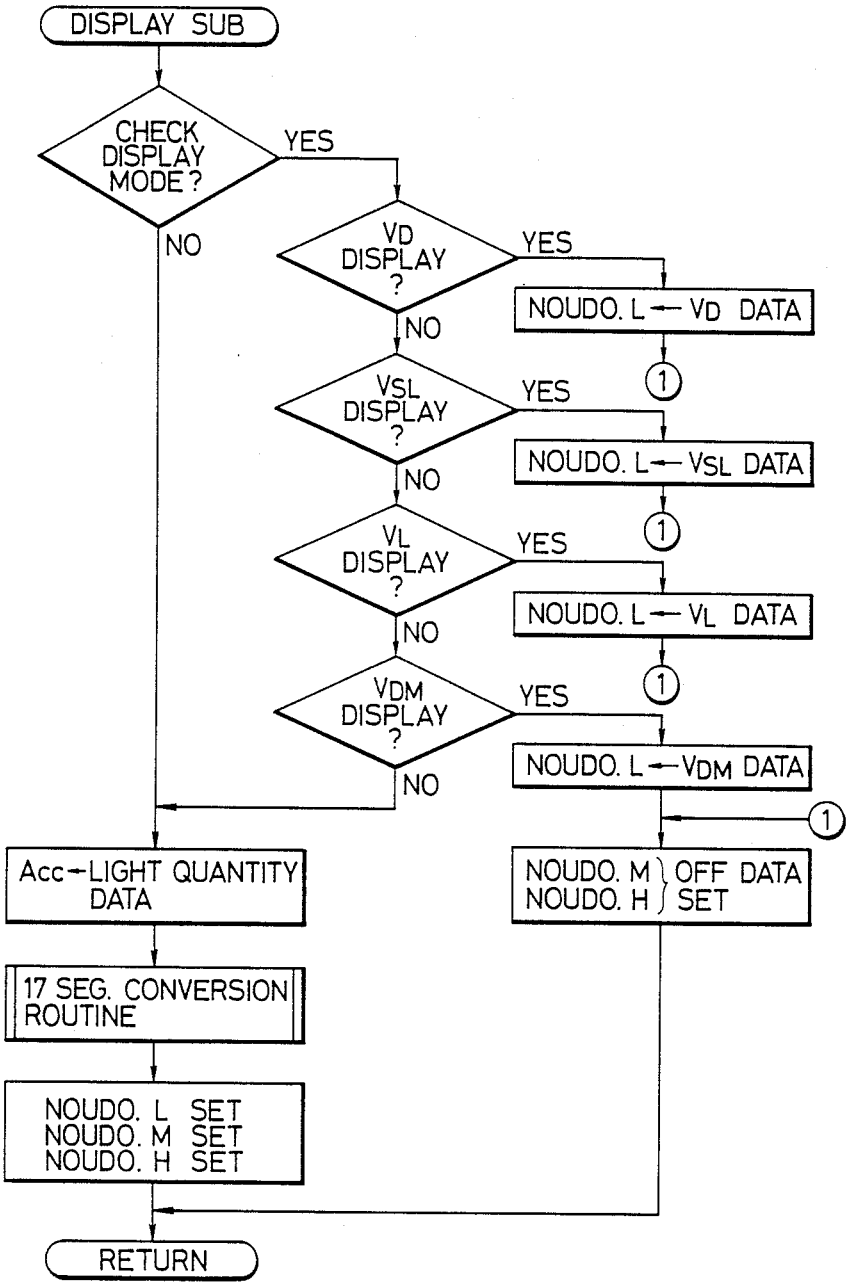
FIG. 16 is a flow chart showing the control flow for display operation.

FIG. 12 shows the stop display as a data display function component. FIG. 16 shows the control flow for data display.

Of the 17 LEDs for stop display (density display 215), binary values of 256 steps from 00 to 0FFH are indicated by the 8 right LEDs. FIG. 12 shows "01000110B" (=46H) which indicates the surface potential of 0 V in accordance with a table (not shown).

In this embodiment, the stop display is used to display the drum surface potential which is sampled at predetermined timings. However, a similar display may be performed for temperature display of the fixing heater obtained through the temperature sensor or the like.

Furthermore, the data to be displayed is not limited to the direct data but may be extended to maintenance information (jamming frequency, drum replacement frequency, and the like).

In this embodiment, the display has 17 LEDs. However, the present invention is not limited to this. The present invention is therefore similarly applicable to a display which displays the stop value in number by 7-segment LEDs.

The display data selecting means does not require a special switch but can be an input means comprising a combination of 10 keys, magnification key and the like.

In this embodiment, the AE monitor key 223 is incorporated for performing AE measurement and display of the AE measurement obtained at the density display. However, for better operability, after the AE measurement is performed by means of this key, the machine can be automatically set in the manual mode. The light quantity can be locked, and a copy can be produced at an optimal light quantity in a subsequent copying operation.

This function is particularly useful when the original has portions having extremely different densities. When originals of different densities are shifted from each other intentionally or originals having substantially the same densities are subjected to AE measurement for storage of the light quantities and when the originals are then correctly set for manual copying at an optimal exposure, the operation to be performed by the operator can be simplified and a copy of an optimal light quantity can be obtained.

According to the present invention, since predetermined data and original density are processed to perform an image formation, a copy image of optimal density can be obtained.

In a copying machine having an automatic density control function, the function of performing AE measurement alone is incorporated so that the application range of the machine is not limited (can be applied to originals of different densities) and AE control can be effectively utilized.

When the copying machine of the present invention is considered from the viewpoint of economy, AE control can be performed without producing wasteful copies.

In a copying machine having a function for displaying the copying density, the display can also function for displaying other processing data such as that from a microcomputer. Then, a special display for this function can be omitted, and a copying machine with higher maintenance performance can be provided. Furthermore, any abnormality such as breakdown of the potential sensor can be detected immediately after it occurs.

In this embodiment, the original density is read through the drum potential. However, the reflected light or transmitted light of the original can be directly detected by means of a photosensor to read the original density.

What is claimed is:

1. An image formation apparatus comprising:

image forming means for forming a copy image of an original image on a recording medium, said image forming means being capable of reproducing the original image with different selectable copy magnification;

detecting means for detecting a density of the original image; and control means responsive to an output of said detecting means for controlling an operable condition of said image forming means so as to provide an adequate density of the copy image, said control means being operable to obtain control data in accordance with the output of said detecting means, wherein a predetermined relation exists between the control data and the density of the original image, and to control the operable condition of said image forming means based on the thus obtained control data, wherein a relation between the density of the original image and the control data is varied in accordance with the copy magnification.

2. An image formation apparatus comprising:

image forming means for forming a copy image of an original image on a recording medium;

detecting means for detecting a density of the original image;

control means responsive to an output of said detecting means for controlling an operable condition of said image forming means so as to provide an adequate density of the copy image;

display means for displaying a copy density set in accordance with the output of said detecting means; and selecting means for selecting either a first mode in which said control means controls the operable condition of said image forming means, and said display means displays a copy density set in accordance with the output of said detecting means, or a second mode in which said display means displays a copy density set in accordance with the output of said detecting means, but said control means does not control the operable condition of said image forming means.

3. An apparatus according to claim 2, wherein an image corresponding to the original image is formed after the operation condition is controlled in the first mode.

4. An apparatus according to claim 2, further comprising setting means for manually setting the density of the original image, and wherein said apparatus is operative in an automatic density control mode for controlling the operation condition in accordance with the detection value from said detecting means and in a manual density control mode for controlling the operation condition in accordance with the set value by said setting means.

5. An apparatus according to claim 4, wherein the density is displayed at said display means and the mode is shifted to the manual density control mode in accordance with the detection value in the second mode.

6. An apparatus according to claim 2, wherein said display means has a plurality of light-emitting elements which display the copy density stepwise.

7. An image forming apparatus comprising:

image forming means for forming a copy image of an original image on a recording medium;

detecting means for detecting an image forming condition;

display means for displaying a set copy density; and control means for controlling said display means so as to display data according to an output of said detecting means, said data being different from said copy density.

8. An apparatus according to claim 7, wherein said data is data on a surface state of the recording medium.

9. An apparatus according to claim 8, wherein the surface state is a surface potential.

10. An apparatus according to claim 7, wherein said display means comprises a plurality of light-emitting elements, and the other data is digitally displayed by controlling flashing of said plurality of light-emitting elements.

* * * * *